US011390446B2

(12) United States Patent
Hengen

(10) Patent No.: US 11,390,446 B2
(45) Date of Patent: Jul. 19, 2022

(54) CONTAINER APPARATUS

(71) Applicant: Brett W. Hengen, Myrtle Beach, SC (US)

(72) Inventor: Brett W. Hengen, Myrtle Beach, SC (US)

( * ) Notice: Subject to any disclaimer, the term of this patent is extended or adjusted under 35 U.S.C. 154(b) by 87 days.

(21) Appl. No.: 16/550,821

(22) Filed: Aug. 26, 2019

(65) Prior Publication Data

US 2020/0062479 A1 Feb. 27, 2020

Related U.S. Application Data

(60) Provisional application No. 62/722,346, filed on Aug. 24, 2018.

(51) Int. Cl.

| | |
|---|---|
| ***B65D 21/00*** | (2006.01) |
| ***B65D 81/05*** | (2006.01) |
| ***B65D 21/02*** | (2006.01) |
| ***B65D 55/02*** | (2006.01) |

(52) U.S. Cl.

CPC ..... *B65D 81/051* (2013.01); *B65D 21/0223* (2013.01); *B65D 55/02* (2013.01)

(58) Field of Classification Search

CPC ..... B65D 81/051; B65D 81/022; B65D 81/3818; B65D 81/05; B65D 21/0223; B65D 55/02

USPC ..... 220/4.21, 4.22, 4.26, 4.27, 592.25; 206/508, 521, 523, 427

See application file for complete search history.

(56) References Cited

U.S. PATENT DOCUMENTS

| | | | | | |
|---|---|---|---|---|---|
| 4,082,208 | A * | 4/1978 | Lane, Jr. | A45F 3/04 | 220/4.27 |
| 4,295,345 | A * | 10/1981 | Atkinson | B65D 81/3834 | 62/371 |
| 5,215,208 | A * | 6/1993 | Jackson | A45C 11/20 | 206/427 |
| 5,794,773 | A * | 8/1998 | Moyer | A63B 47/007 | 206/315.91 |
| 6,206,223 | B1 * | 3/2001 | Wicker | B65D 81/3879 | 220/375 |
| 2006/0254946 | A1 * | 11/2006 | Becklin | B65D 21/0223 | 206/508 |
| 2008/0135554 | A1 * | 6/2008 | Hill | B65D 81/052 | 220/215 |
| 2010/0140282 | A1 * | 6/2010 | Steg | B65D 77/208 | 220/780 |

* cited by examiner

*Primary Examiner* — Don M Anderson
*Assistant Examiner* — Elizabeth J Volz
(74) *Attorney, Agent, or Firm* — Ashley Law Firm P.C.; Stephen S. Ashley, Jr.

(57) ABSTRACT

Disclosed is a container apparatus for shipping fragile items, such as beer and wine bottles. The container apparatus can include a housing and a cushioning member positioned within the interior of the housing. The housing can include first and second complementary sections that are releasably attached to each other by a plurality of complementary attachment members. The cushioning member can be made of a shock absorbing material and a bottle can be positioned within a cylindrical cavity formed in the cushioning member, which provides a barrier between the bottle and the housing that can absorb force from an impact to the housing thereby protecting the bottle from damage.

16 Claims, 19 Drawing Sheets

CONTAINER APPARATUS

CROSS REFERENCE TO RELATED APPLICATIONS

This application claims priority to U.S. Provisional Patent Application No. 62/722,346, filed Aug. 24, 2018, which is incorporated by reference herein. In addition, U.S. Provisional Patent Application No. 62/486,150, filed Apr. 17, 2017, is incorporated herein by reference.

TECHNICAL FIELD

The present invention relates to containers for use in transporting items. An embodiment of the invention comprises a container apparatus adapted for transporting beverage bottles of varying size.

BACKGROUND

Craft beers, which generally refers to beers made in relatively small breweries using traditional non-mechanized brewing processes, have become very popular in recent times. Craft beers are sold in a variety of various sized glass bottles. Consumers often purchase particular craft beers that must be shipped to the purchaser from distant locations. As such, there is a need for a shipping container that can securely hold bottles of various sizes.

SUMMARY

Therefore, one object of the present invention is to provide a shipping container that can securely contain multiple bottles of varying sizes. This and other objects of the invention can be achieved in the various embodiments of the invention disclosed herein.

One embodiment of the invention comprises a shipping container adapted for securely shipping fragile items, such as glass bottles. The terms "ship" and "shipping", as used herein, refer broadly to transporting an item by any and all means of transportation on the ground, air and/or sea.

Another embodiment of the invention comprises a kit comprising a container, and at least one cushioning member adapted for positioning a bottle or can therein.

Another embodiment of the invention comprises a container apparatus comprising a housing comprising a first housing section releasably attached to a second housing section. A cushioning member is positioned within the interior area of the housing, and the cushioning member adapted to contain an item and provide a barrier between the item and the housing that absorbs force from an impact to the housing.

According to an embodiment of the invention, the housing is comprised of propylene plastic.

According to another embodiment of the invention, the cushioning member is comprised of polyethylene foam.

According to another embodiment of the invention, the container apparatus is adapted containing and transporting a bottle and a can.

According to another embodiment of the invention, the housing has a substantially rectangular prism shape.

According to another embodiment of the invention, the cushioning member comprises a body section having a substantially rectangular prism shape and has a substantially cylindrical cavity formed therein.

According to another embodiment of the invention, the item comprises a bottle and the substantially cylindrical cavity of the body section of the cushioning member receives the bottle therein. The cushioning member further comprises a top section removably positioned within the substantially cylindrical cavity of the body section, and the top section has a substantially cylindrical shape and defines a substantially cylindrical cavity for receiving at least a portion of the neck of a bottle therein.

According to another embodiment of the invention, the container apparatus can contain a pair of beverage cans. The cushioning member further comprises a first cylindrical member defining a cylindrical cavity for receiving the first can therein and a second cylindrical member defining a cylindrical cavity for receiving the second can therein. The first and second cylindrical members can be positioned within the substantially cylindrical cavity of the body section.

According to another embodiment of the invention, the housing has a substantially rectangular prism shape, and the first housing section and the second housing section each comprise a rectangular face panel and a rectangular sidewall extending outwardly from the face panel. The sidewall includes first and second opposed sides and third and fourth opposed sides. The first housing section includes a first tab member positioned on the first side of the first housing section and extending outwardly therefrom, and a second tab member positioned on the second side of the first housing section and extending outwardly therefrom. The second housing section includes a first locking member positioned on the first side of the second housing section to receive and releasably engage the first tab member of the first housing section, and a second locking member positioned on the second side of the second housing section to receive and releasably engage the second tab member of the first housing section, whereby the first housing section is releasably attached to the second housing section.

According to another embodiment of the invention, the face panel of each of the first housing section and the second housing section include a plurality of knobs extending outwardly therefrom and a plurality of recesses formed therein to facilitate stacking of the container apparatus with a like container apparatus.

According to another embodiment of the invention, the second housing section further comprises a first tab member positioned on the first side of the second housing and a second tab member positioned on the second side of the second housing section. The first housing section further comprises a first locking member positioned on the first side of the first housing section to receive and releasably engage the first tab member of the second housing section, and a second locking member positioned on the second side of the first housing section to receive and releasably engage the first tab member of the second housing section.

According to another embodiment of the invention, the first side and the second side of each of the first housing section and the second housing section include indented sections. Each of the first and second tab members and each of the first and second locking members can be positioned in one of the indented sections.

Another embodiment of the invention comprises a container apparatus kit comprising a plurality of container apparatuses, and each apparatus comprises a housing comprising a first housing section releasably attached to a second housing section. A cushioning member can be positioned within the interior area of the housing, and the cushioning member is adapted to contain an item and provide a barrier between the item and the housing that absorbs force from an impact to the housing. The first housing section and the second housing section each comprise a substantially rectangular face panel and a substantially rectangular sidewall extending outwardly from the face panel. The face panel of the first housing section defining a top of the housing and the face panel of the second housing section defining a bottom of the housing, and the face panel of the first housing section and the face panel of the second housing section each have a plurality of knobs extending outwardly therefrom and a plurality of recesses formed therein such that when a first container apparatus is positioned on the top of a second container apparatus the plurality of knobs extending outwardly from top of the second container apparatus are received in the plurality of recesses formed in the bottom of the first container apparatus and the plurality of knobs extending outwardly from the bottom of the first container apparatus are received in the plurality of recesses formed in the top of the second container apparatus, such that the first container apparatus is frictionally engaged with the second container apparatus.

According to another embodiment of the invention, an indented section is formed in the first and second housing sections of each container apparatus, and a fastening member can be within the indented section of a first container apparatus and the indented section of a second container apparatus when the first container apparatus is positioned on top of the second container apparatus.

According to another embodiment of the invention, the fastening member can be a strap having a first and a second surface opposed to the first surface, wherein a plurality of hook fasteners are positioned on the first surface and a plurality of loop fasteners adapted for complementary engagement with the plurality of hook fasteners are positioned on the second surface.

According to another embodiment of the invention, the kit can be used to contain and transport bottles and/or cans. The housing of each container apparatus has a substantially rectangular prism shape, and the cushioning member comprises a body section having a substantially rectangular prism shape and a substantially cylindrical cavity formed in the body section. A top section can be removably positioned within the substantially cylindrical cavity of the body section. The top section has a substantially cylindrical shape and defines a substantially cylindrical cavity for receiving at least a portion of the neck of a bottle, such as a wine or beer bottle. The kit can also include a pair of cylindrical members that each have a cylindrical cavity for receiving a can therein. The cylindrical members can be made of a shock absorbing material and sized such that the cylindrical members can be positioned within the substantially cylindrical cavity of the body section of the cushioning member.

DETAILED DESCRIPTION OF PREFERRED EMBODIMENTS

Figure 1:
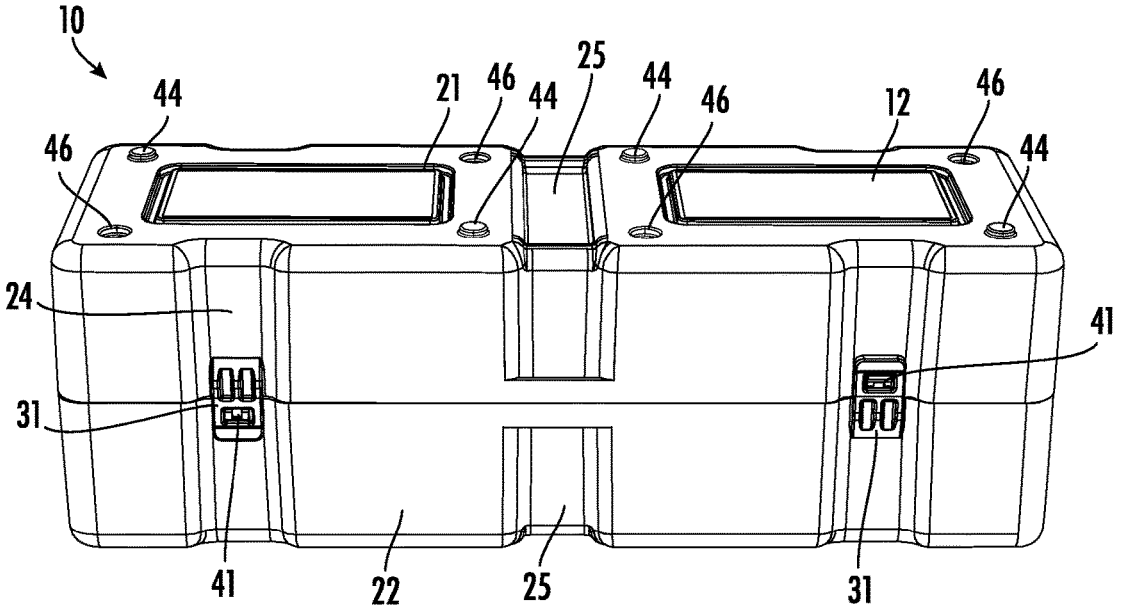
FIG. 1 is a perspective view of a container apparatus according to a preferred embodiment of the invention.
Figure 2:
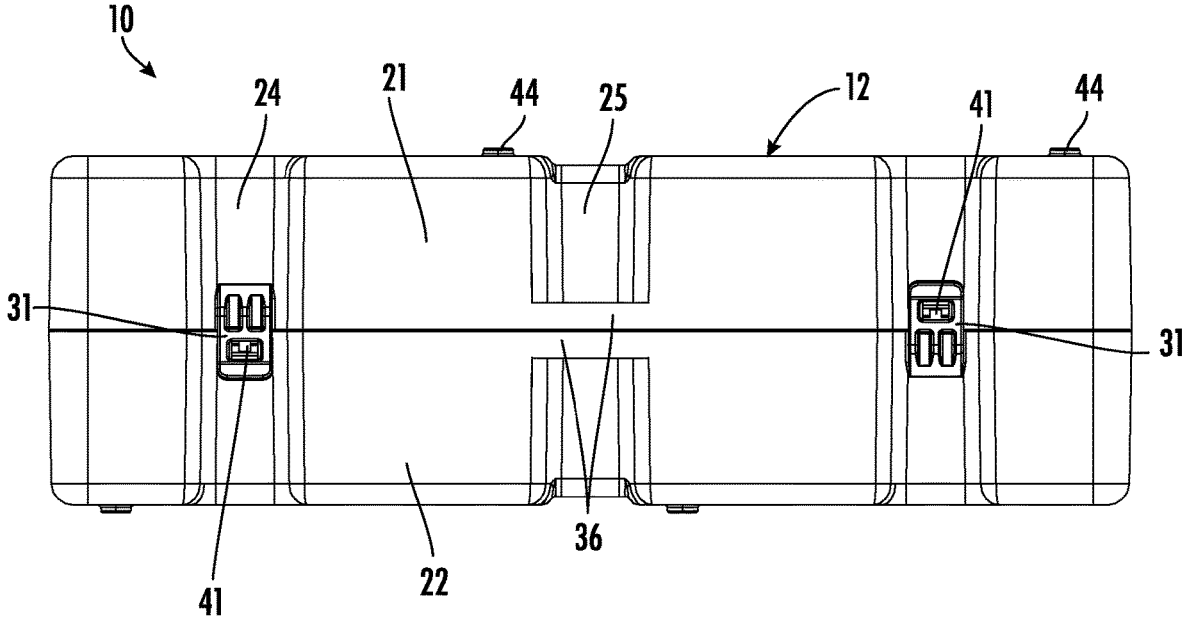
FIG. 2 is a side elevational view of the apparatus of FIG. 1.
Figure 3:
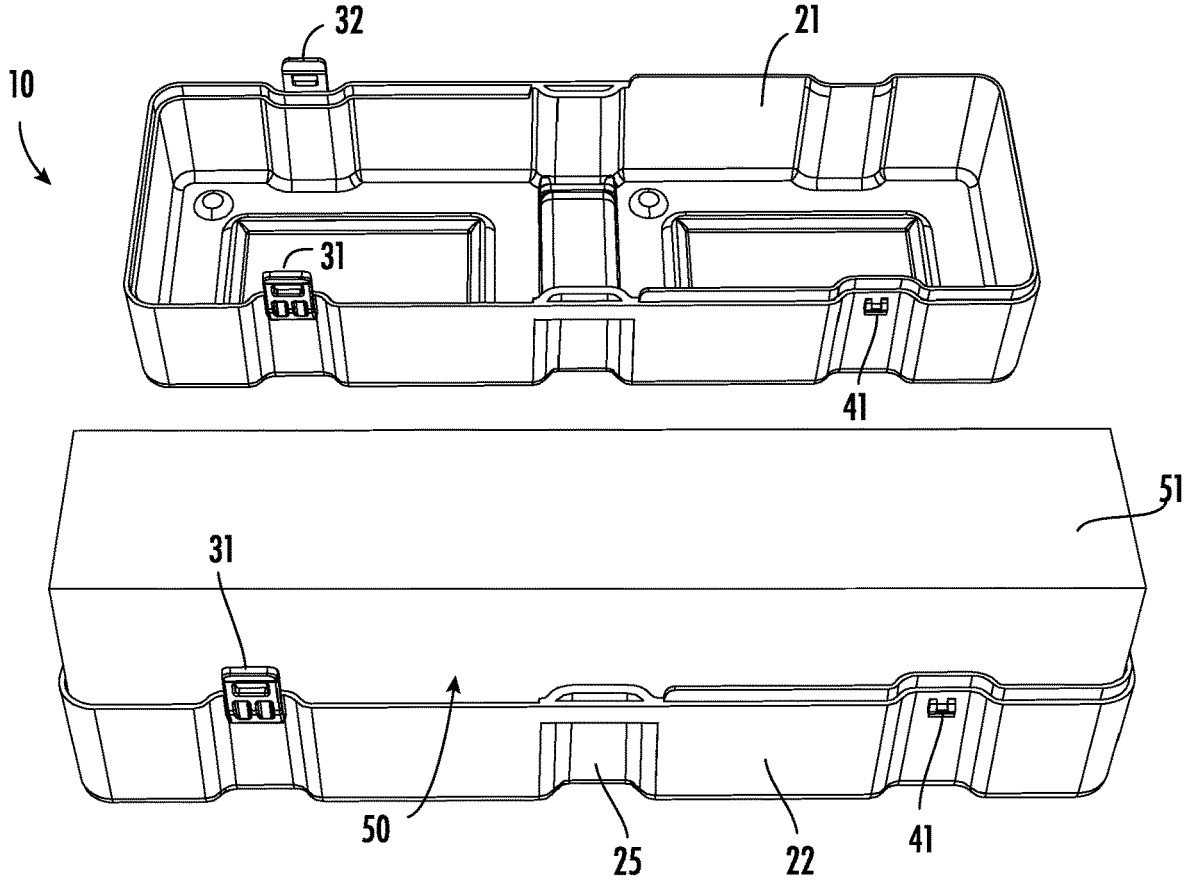
FIG. 3 is an exploded view of the apparatus of FIG. 1.
Figure 4:
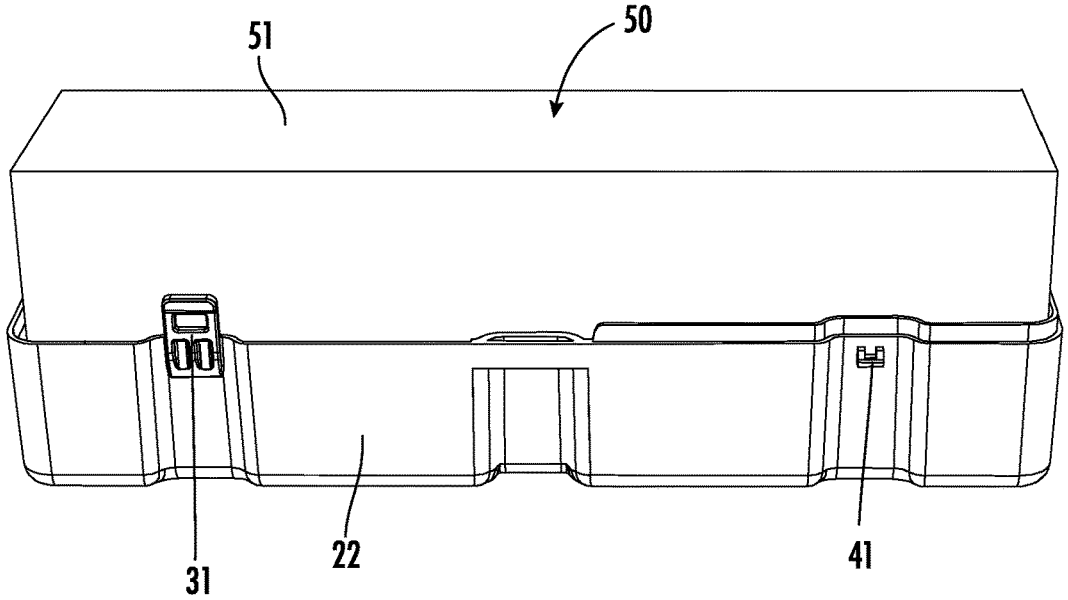
FIG. 4 is a partial perspective view of the apparatus of FIG. 1.
Figure 5:
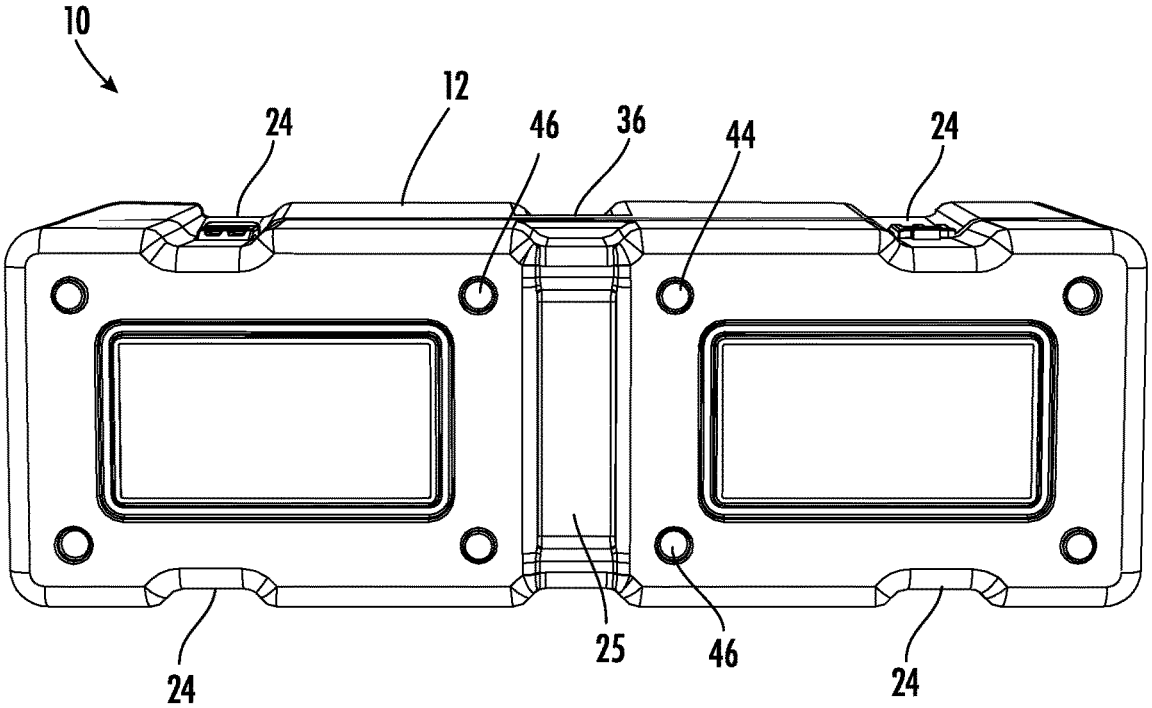
FIG. 5 is a bottom plan view of the apparatus of FIG. 1.

A container apparatus according to a preferred embodiment of the invention is illustrated in FIGS. 1-19, and shown generally at reference numeral 10. The apparatus 10 comprises a hollow housing 12, and a cushioning member 50 contained within the housing 12. The housing 12 is made of a hard and durable material, such as propylene plastic. The housing 12 can be made by injection molding, or other suitable process. The cushioning member 50 is made of a soft, durable and shock absorbing material, such as polyethylene foam or polyurethane foam. Preferably, the cushioning member 50 is made of a closed cell foam, such as 1.7 pound density polyethylene foam. The housing 12 preferably has a substantially rectangular prism shape, as shown in FIGS. 1 and 2.

Figure 6:
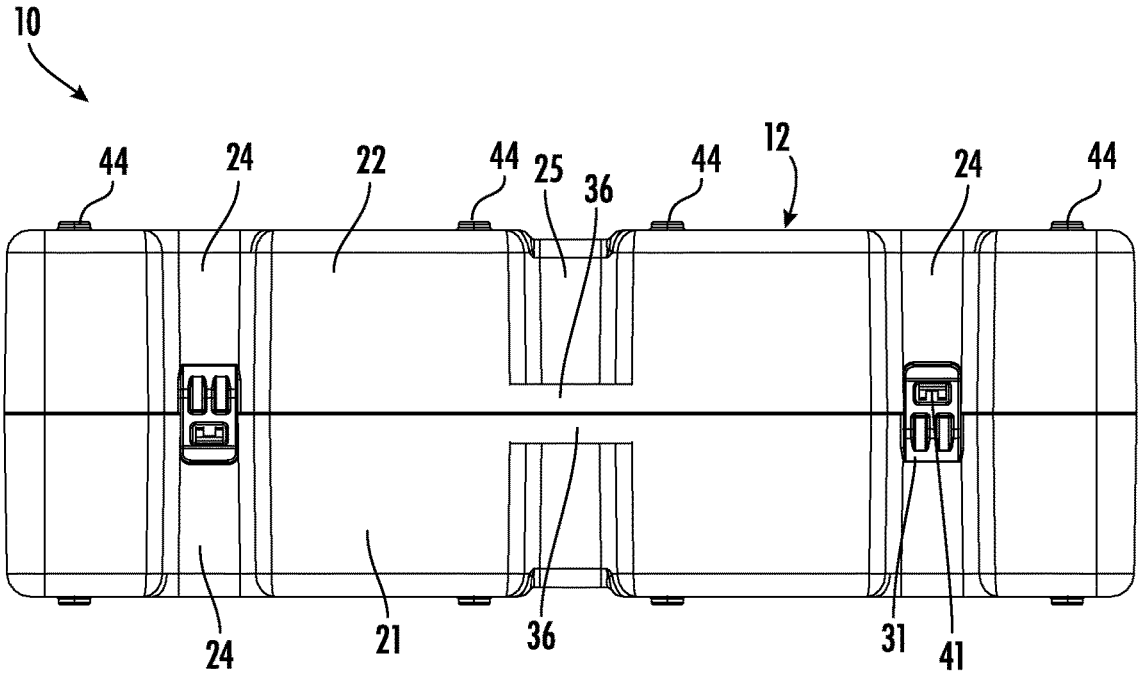
FIG. 6 is a side elevation of the apparatus of FIG. 1.
Figure 7:
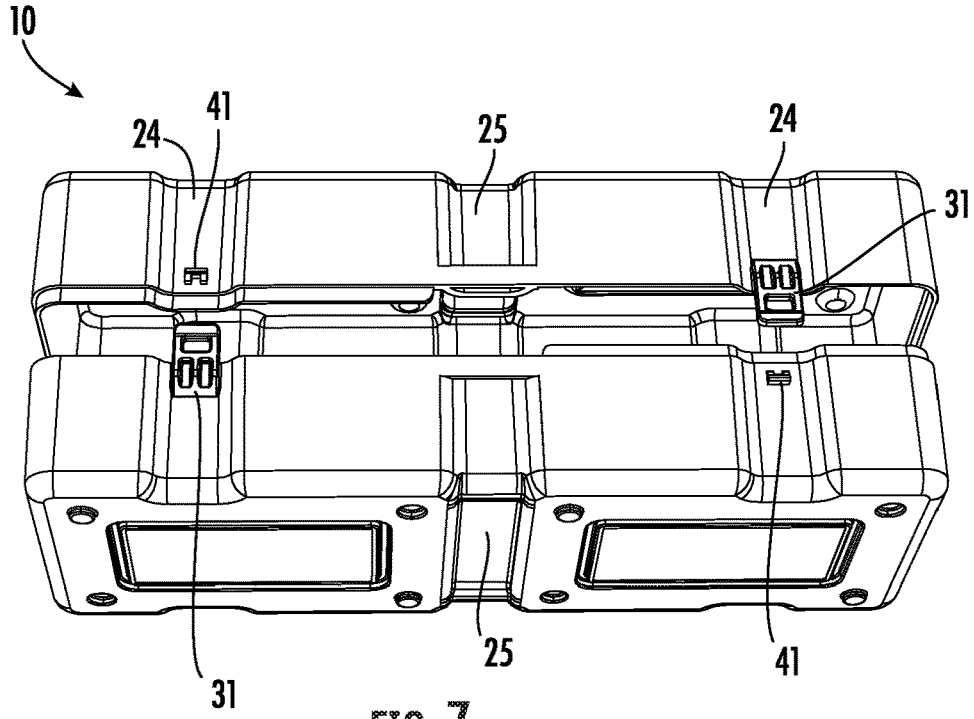
FIG. 7 is an exploded view of the apparatus of FIG. 1.
Figure 8:
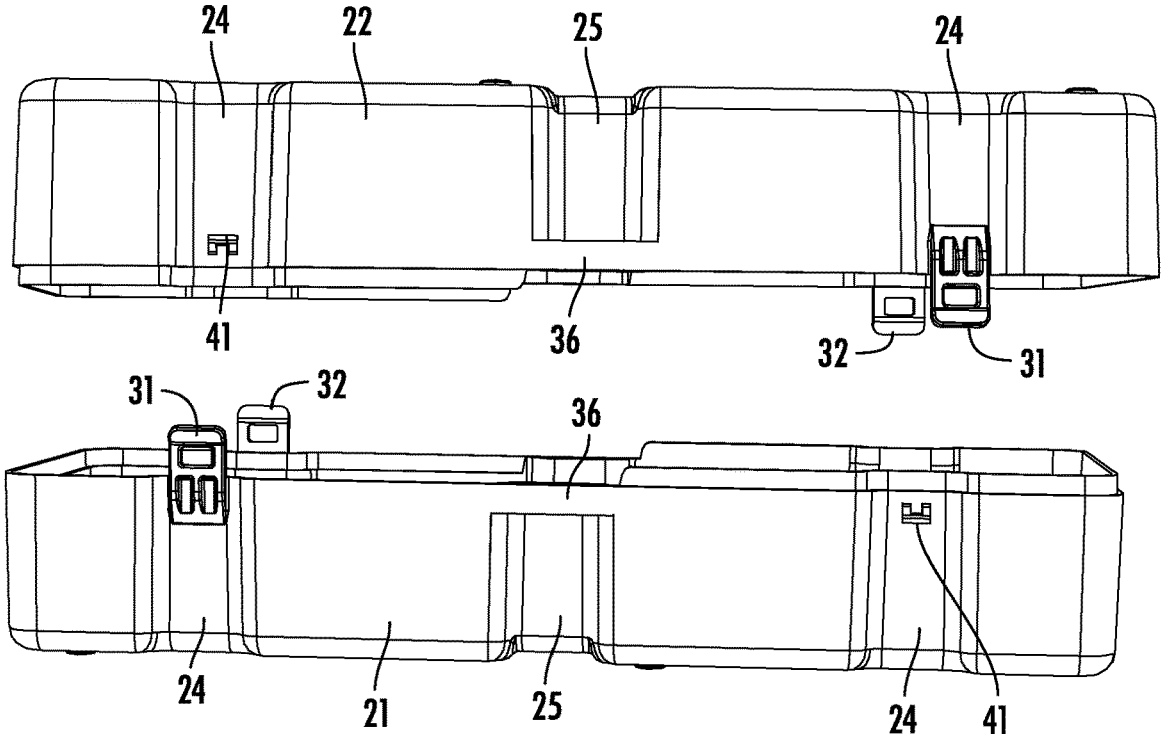
FIG. 8 is another exploded view of the apparatus of FIG. 1.
Figure 9:
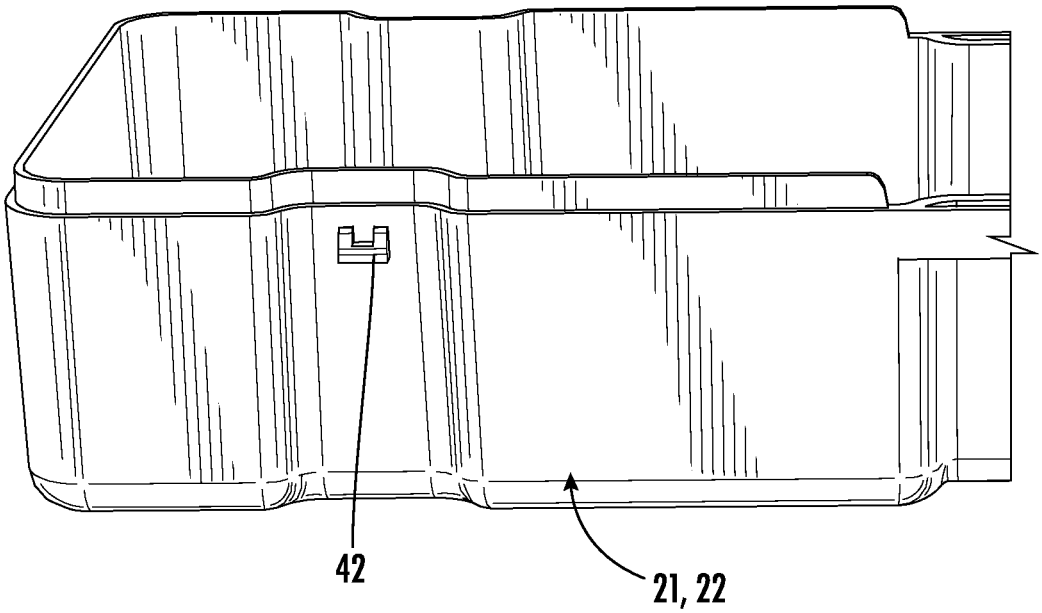
FIG. 9 is a partial perspective view of the apparatus of FIG. 1.
Figure 10:
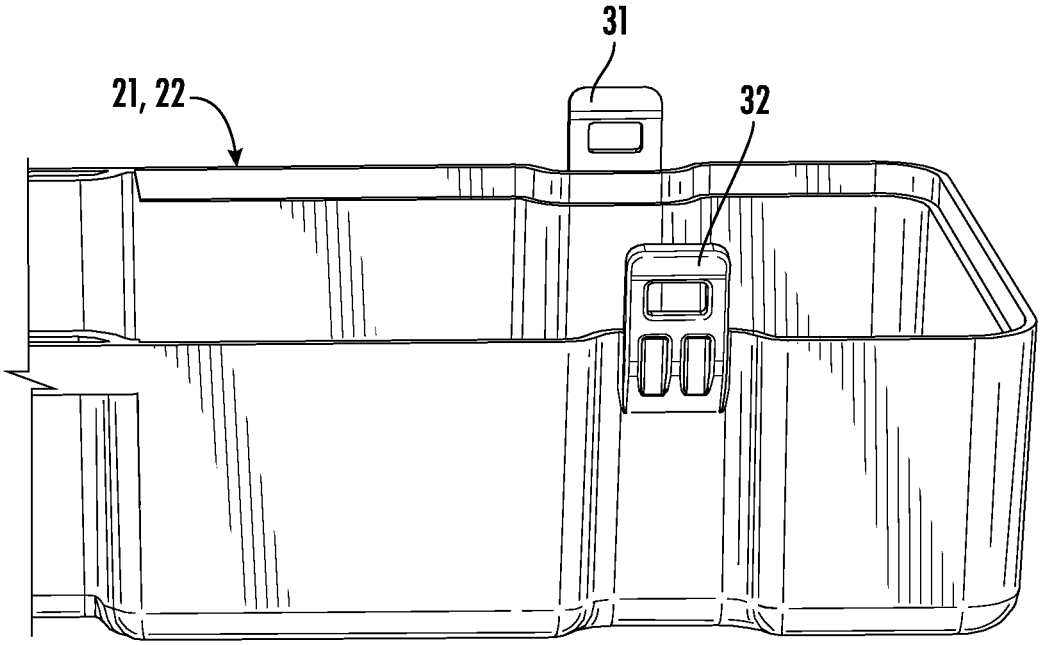
FIG. 10 is another partial perspective view of the apparatus of FIG. 1.
Figure 11:
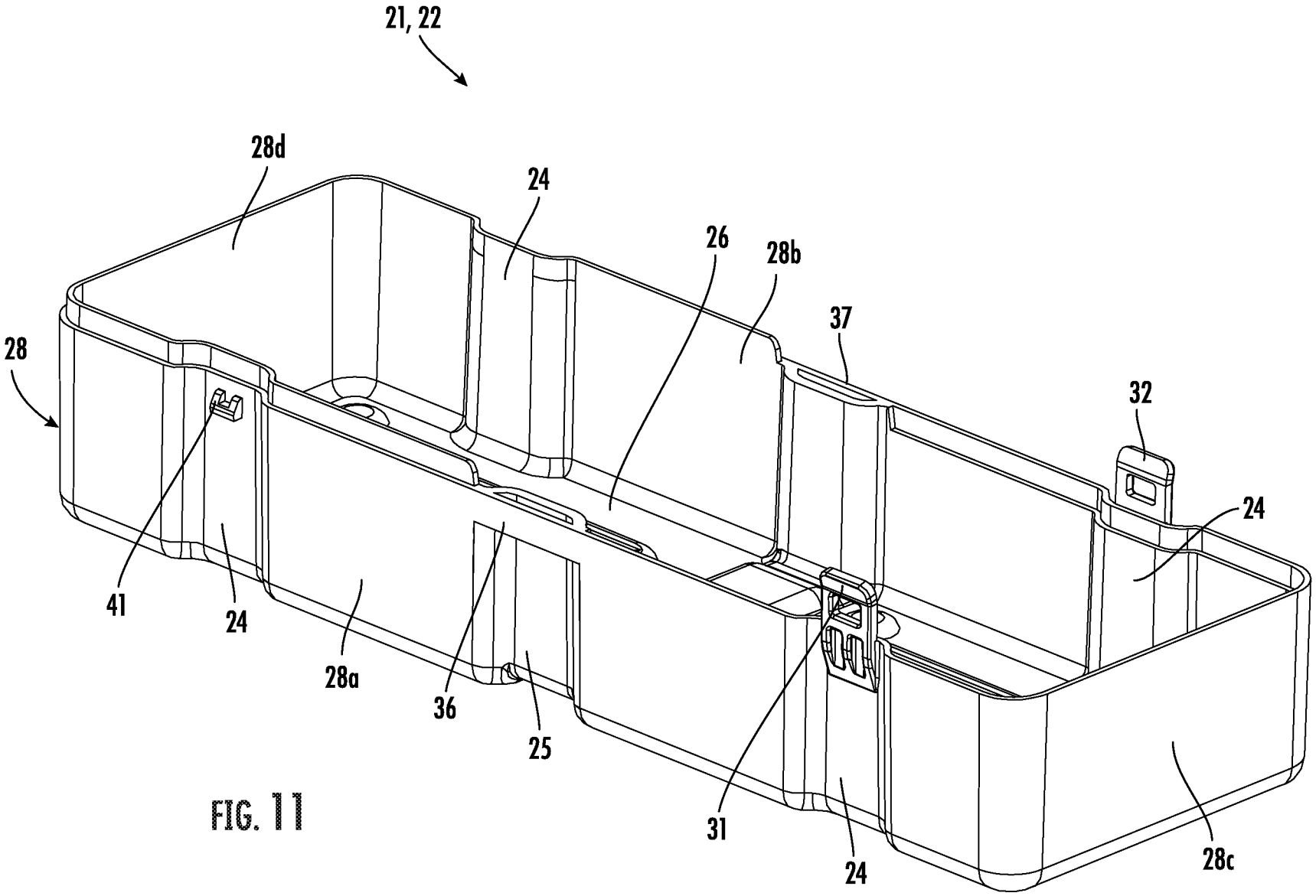
FIG. 11 is another partial perspective view of the apparatus of FIG. 1.
Figure 12:
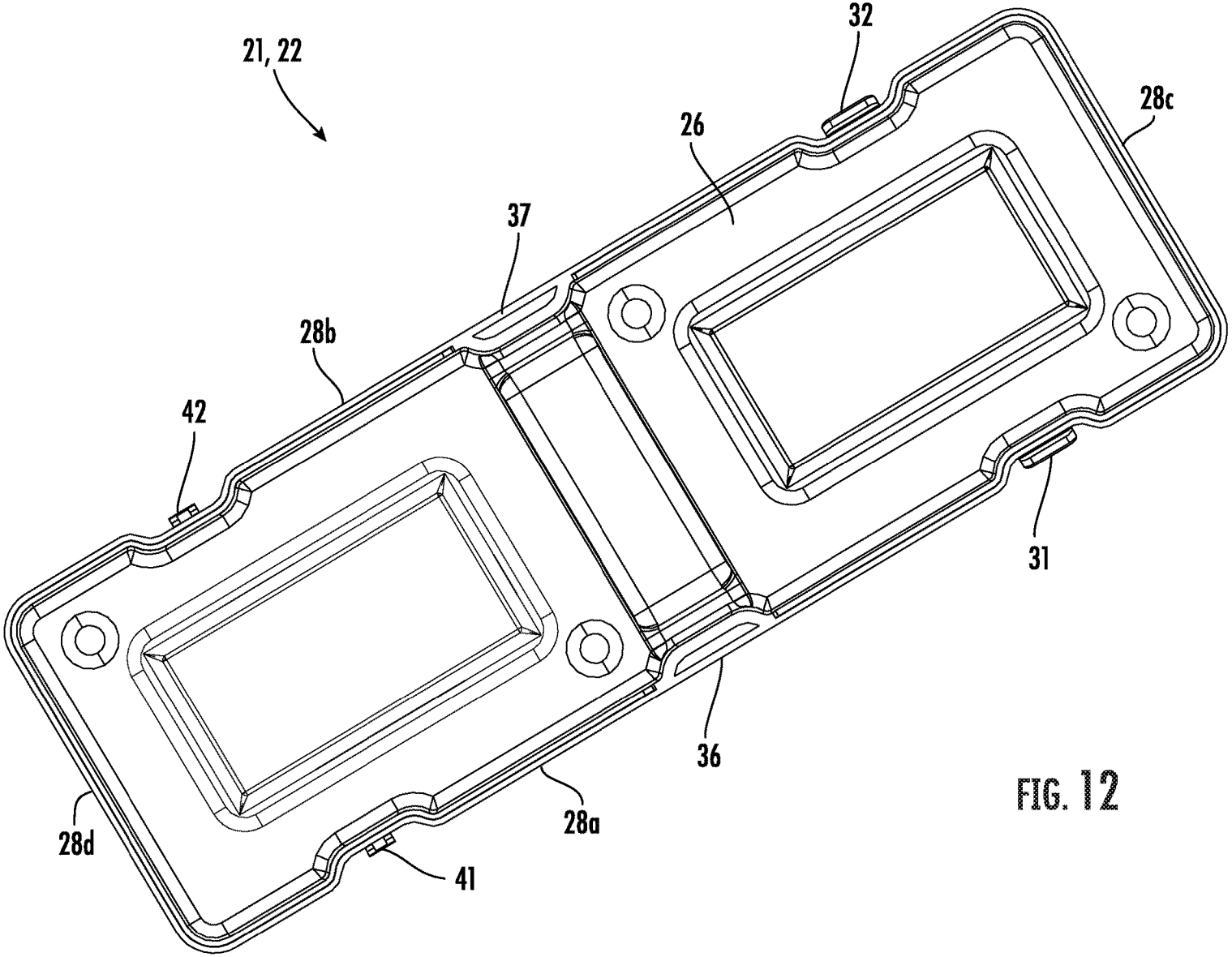
FIG. 12 is another partial perspective view of the apparatus of FIG. 1.

The housing 12 can be comprised of first and second complementary sections 21, 22 that are releasably attached to each other, as shown in FIGS. 6-8. Each housing section 21, 22 can comprise a substantially rectangular face panel 26 face panel and a substantially rectangular sidewall 28 extending outwardly from the face panel 26, as shown in FIGS. 11 and 12. The substantially rectangular sidewall 28 includes first and second opposed sides 28*a*, 28*b* and third and fourth opposed sides 28*c*, 28*d*. The face panel 26 of one housing section 21 can be a top of the housing 12, and the face panel 26 of the other housing section 22 can be the bottom of the housing.

Each housing section 21, 22 can have a pair of outwardly extending tab members 31, 32 and a pair of complementary locking members 41, 42 formed on the exterior of the housing sections 21, 22. The tab members 31, 32 and the locking members 41, 42 are positioned proximate opposite ends of each section 21, 22. The tab members 31, 32 are adapted to releasably engage the locking members 41, 42. Openings are formed in the tab members 31, 32 such that the locking members 41, 42 can fit into the openings of the tab members 31, 32 thereby attaching the tab members 31, 32 and the locking members 41, 42 together. The tab members 31, 32 and the locking members 41, 42 are positioned at complementary positions on the housing sections 21, 22, such that the tab members 31, 32 of the first section 21 engage the locking members 41, 42 on the second section 22, and the tab members 31, 32 of the second section 22 engage the locking members 41, 42 on the first section 21, as shown in FIGS. 6-8.

Figure 13:
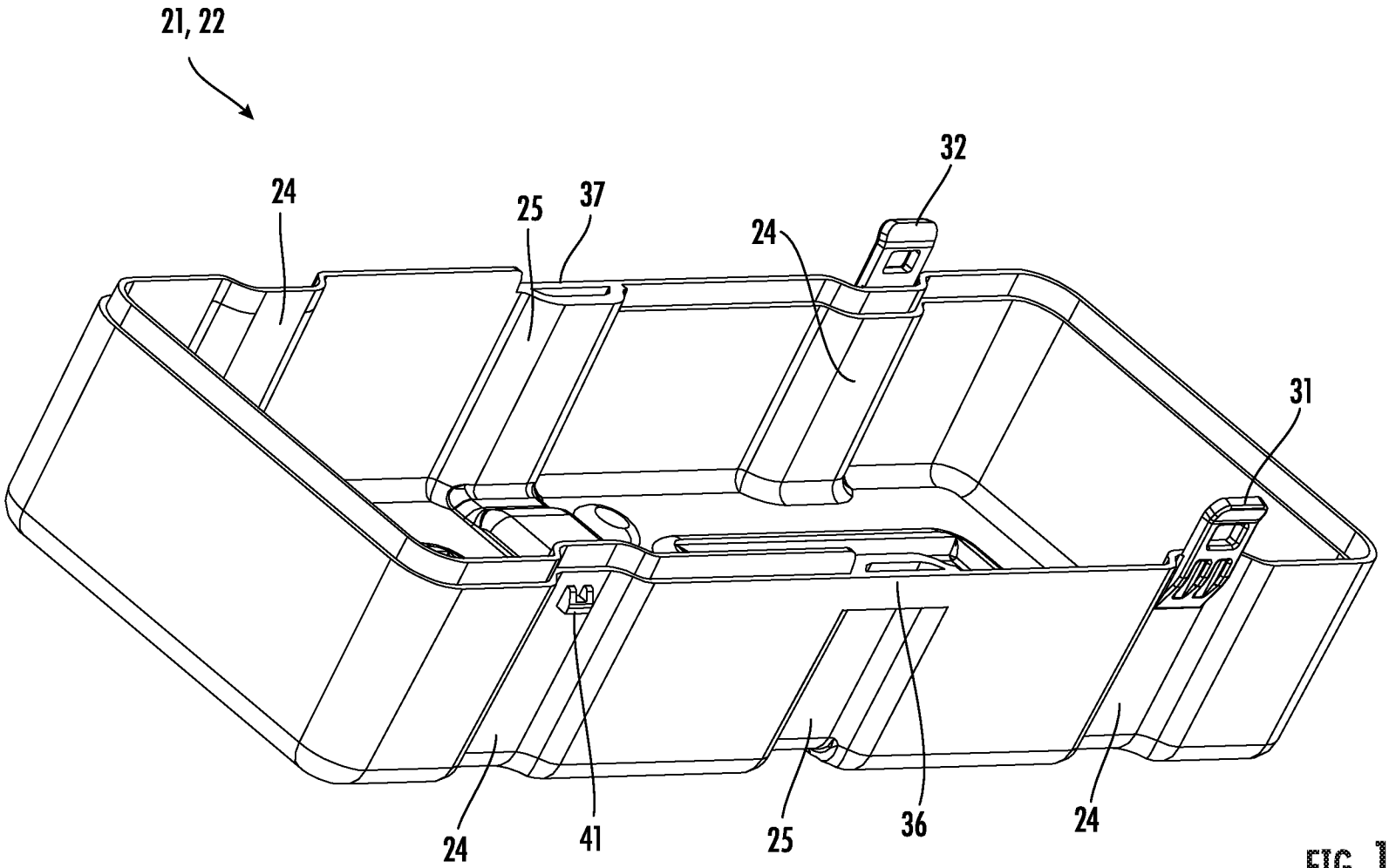
FIG. 13 is another partial perspective view of the apparatus of FIG. 1.

Each housing section 21, 22 can have indented sections 24 that are concave in relation to the exterior surface, on which the tab members 31, 32 and the locking members 41, 42 are positioned, as shown in FIGS. 11-13. The indented sections 24 improve the strength of the container 12 and facilitates nesting of the container 12 with other like containers.

Figure 18:
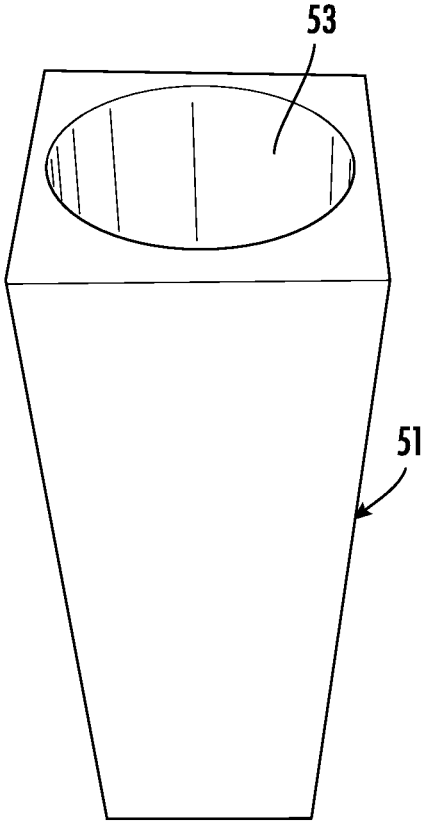
FIG. 18 is a perspective view of a component of a container kit according to a preferred embodiment of the invention.
Figure 19:
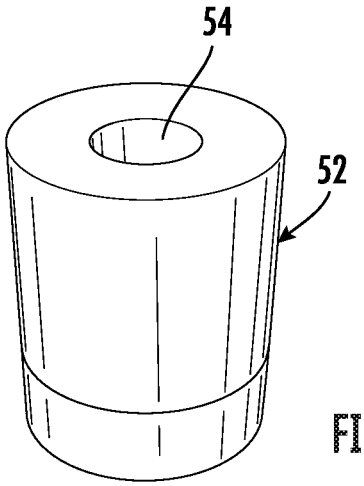
FIG. 19 is a perspective view of another component of a container kit according to a preferred embodiment of the invention.

The cushioning member 50 can be comprised of a main member 51 having a rectangular prism shape, shown in FIG. 18, and a top member 52, shown in FIG. 19. The rectangular cushioning member 51 is hollow with a cylindrical opening 53 formed therein. The top member 52 is cylindrical with a cylindrical opening 54 formed therein. The top member 52 can fit into the cylindrical opening 53 formed in the rectangular member 51. The cushioning member 50 has the following preferred dimensions. The rectangular member 51 preferably has a length of 14.25 inches, and a width of 4.375 inches. The diameter of the cylindrical opening 53 is preferably 3.41 inches, and the length of the cylindrical opening 53 is preferably 13.5 inches. The top member 52 preferably has a length of 3.0 inches, and a diameter of 3.375 inches. The diameter of the cylindrical opening 54 formed in the top member 52 is preferably 1.25 inches.

FIGS. 20-25 illustrate a method of using the container apparatus 10 according to a preferred embodiment of the invention, in which the container apparatus 10 is used to ship a glass bottle, such as a beer, wine or other beverage bottle 60. Preferably, the bottle 60 is a 22 oz. to 25.9 oz. (750 ml) beverage bottle, of the type typically used today for beer and other beverages. Such bottles are also known as "growlers."

Figure 20:
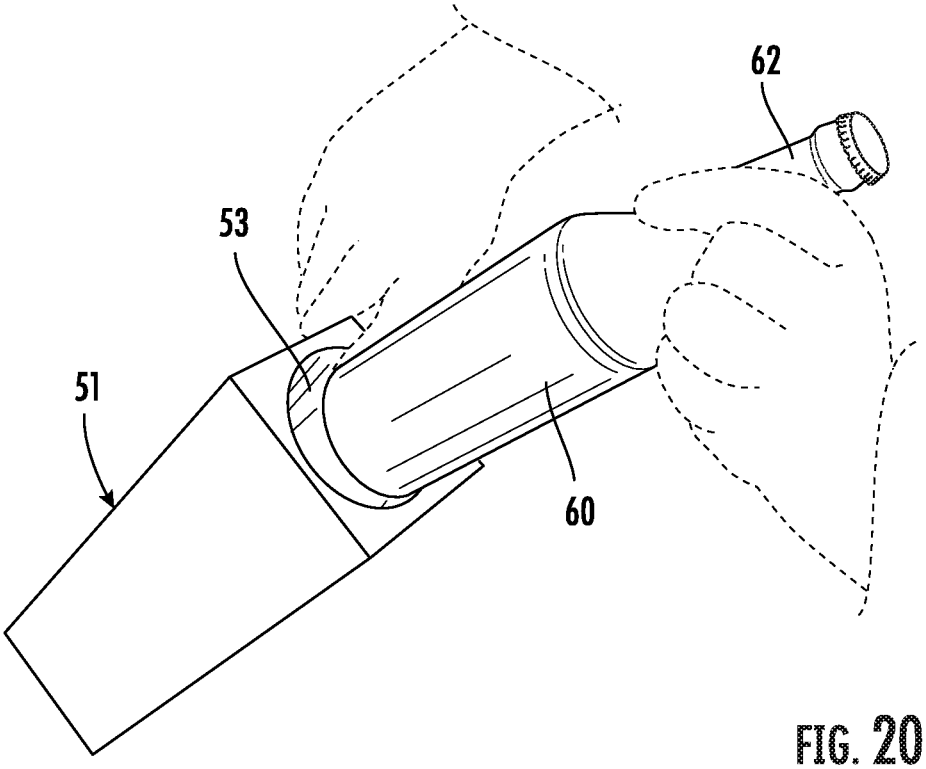
FIG. 20 is an environmental perspective view illustrating a method of using the component of FIG. 18 according to a preferred embodiment of the invention.
Figure 21:
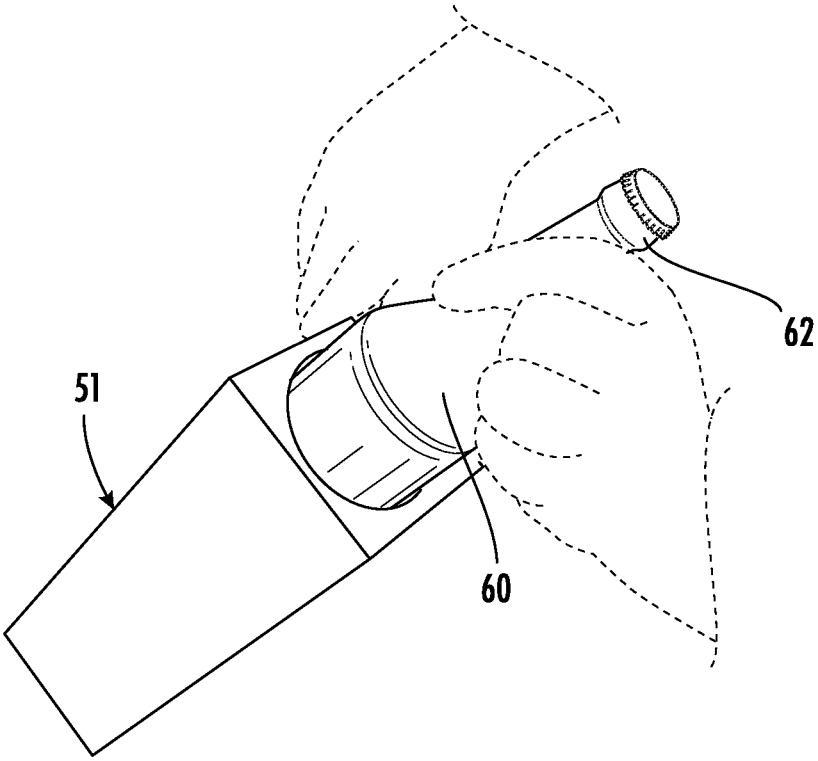
FIG. 21 is another environmental perspective view of the component of FIG. 18.
Figure 22:
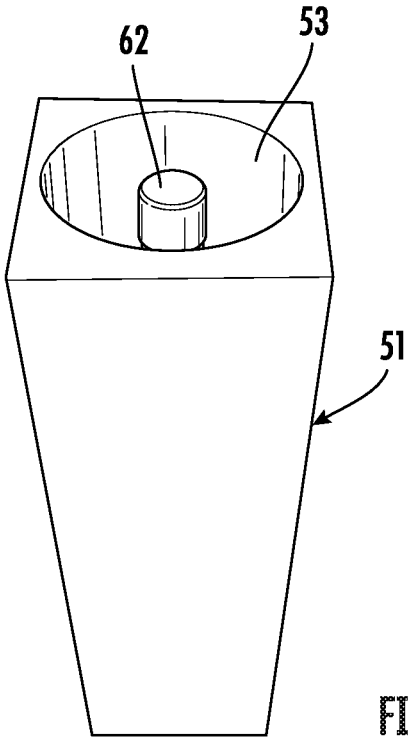
FIG. 22 is another environmental perspective view of the component of FIG. 18.
Figure 23:
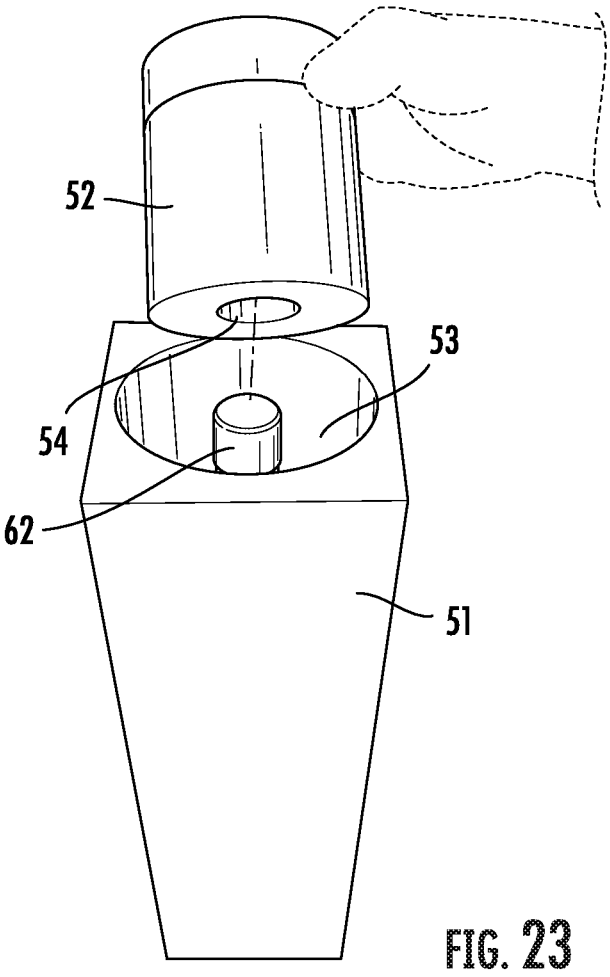
FIG. 23 is an environmental perspective view of the components of FIGS. 18 and 19.
Figure 24:
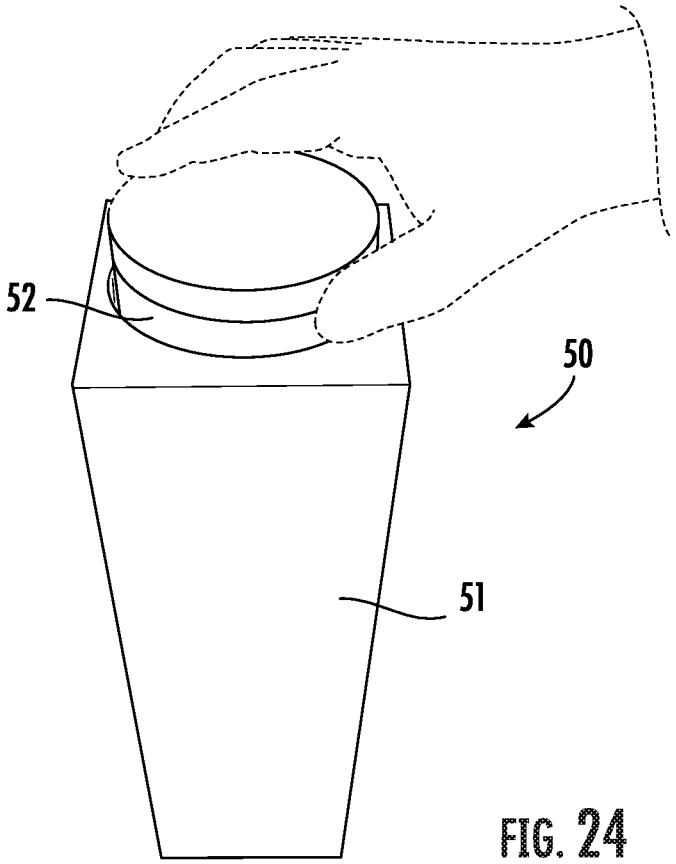
FIG. 24 is another environmental perspective view the components of FIGS. 18 and 19.
Figure 25:
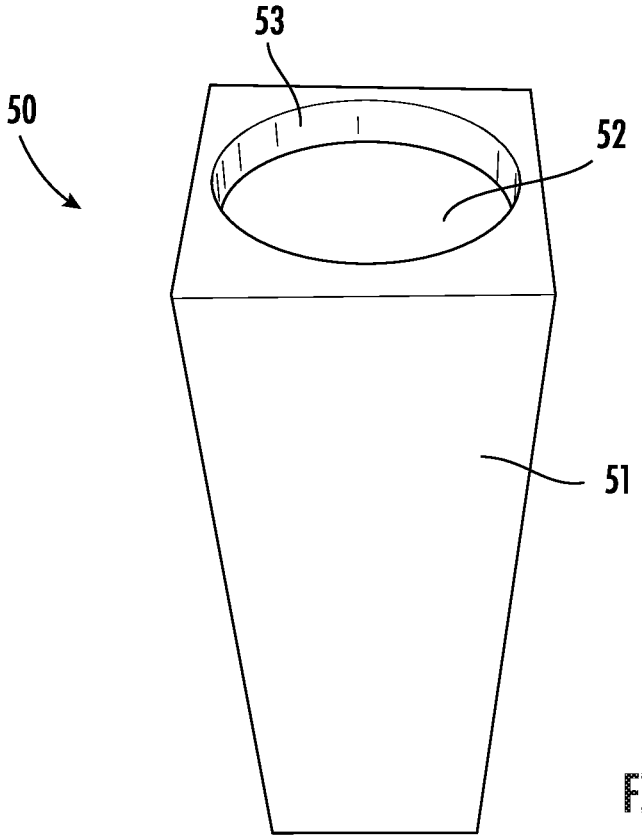
FIG. 25 is another environmental perspective view of the components of FIGS. 18 and 19.
Figure 26:
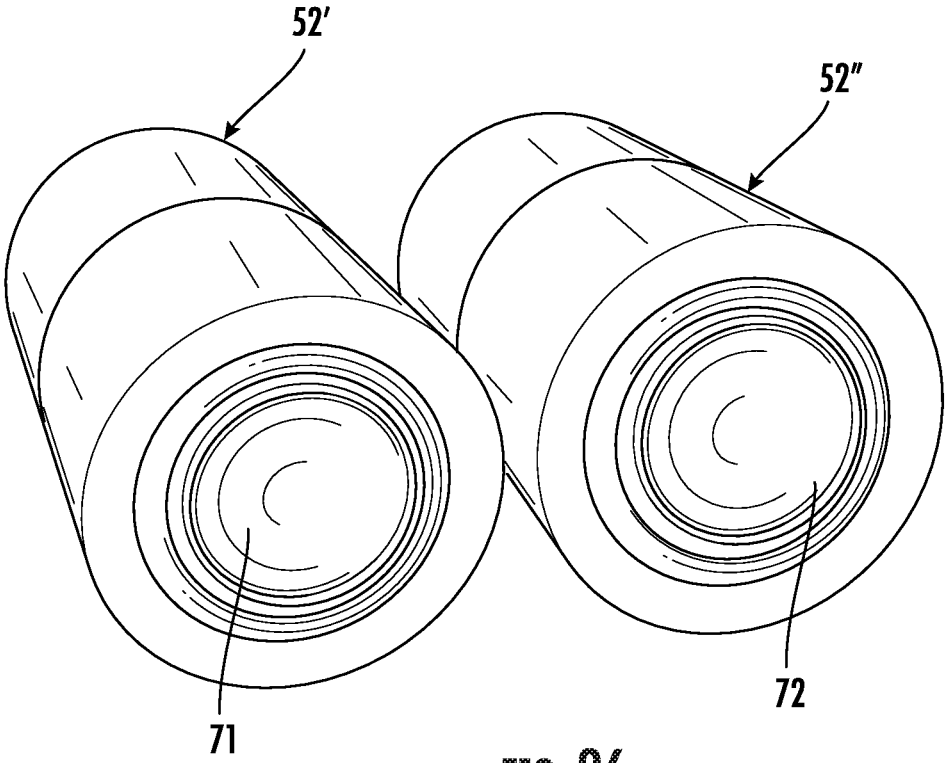
FIG. 26 is an environmental perspective view of components of a container kit according to another preferred embodiment of the invention.
Figure 27:
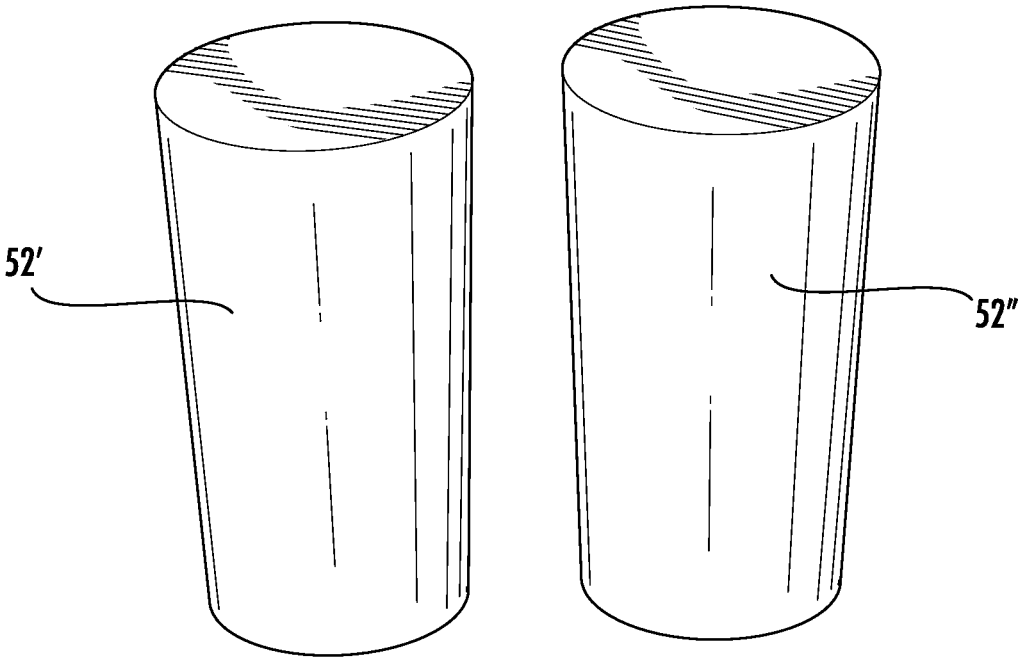
FIG. 27 is a perspective view of the components of FIG. 26.

The housing sections 21, 22 of the container 12 are separated by detaching the tab members 31, 32 of the first section 21 from the locking members 41, 42 of the second section 22, and detaching the tab members 31, 32 of the second section 22 from the locking members 41, 42 of the first section 21. The cushioning member 50 is removed from the container 12. The top member 52 is removed from the rectangular member 51, and the bottle 60 is inserted base first into the cylindrical opening 53 of the rectangular member 51 until the bottom of the bottle 60 reaches the floor of the cylindrical opening 53, as shown in FIGS. 20-22. The top cushioning member 52 is positioned on the top portion (neck) 62 of the bottle 60, with the top 62 of the bottle 60 positioned in the cylindrical opening 54 of the top member 52, as shown in FIGS. 23-24. The top member 52 is pressed downwardly so the neck 62 of the bottle 60 is positioned within the cylindrical opening 54 of the top member 52, as shown in FIG. 25. The cushioning member 50, with the bottle 60 securely contained therein, is positioned back into one of the housing sections 21, 22. The housing sections 21, 22 are attached back together by engaging the tab members 31, 32 of the first section 21 with the locking members 41, 42 on the second section 22, and the tab members 31, 32 of the second section 22 with the locking members 41, 42 on the first section 21, as shown in FIGS. 6-8. The housing sections 21, 22 attached together form a single container 12. The bottle 60, securely contained within the container 12, can be securely shipped to a distant location, such as by U.S. mail or private delivery service.

Figure 14:
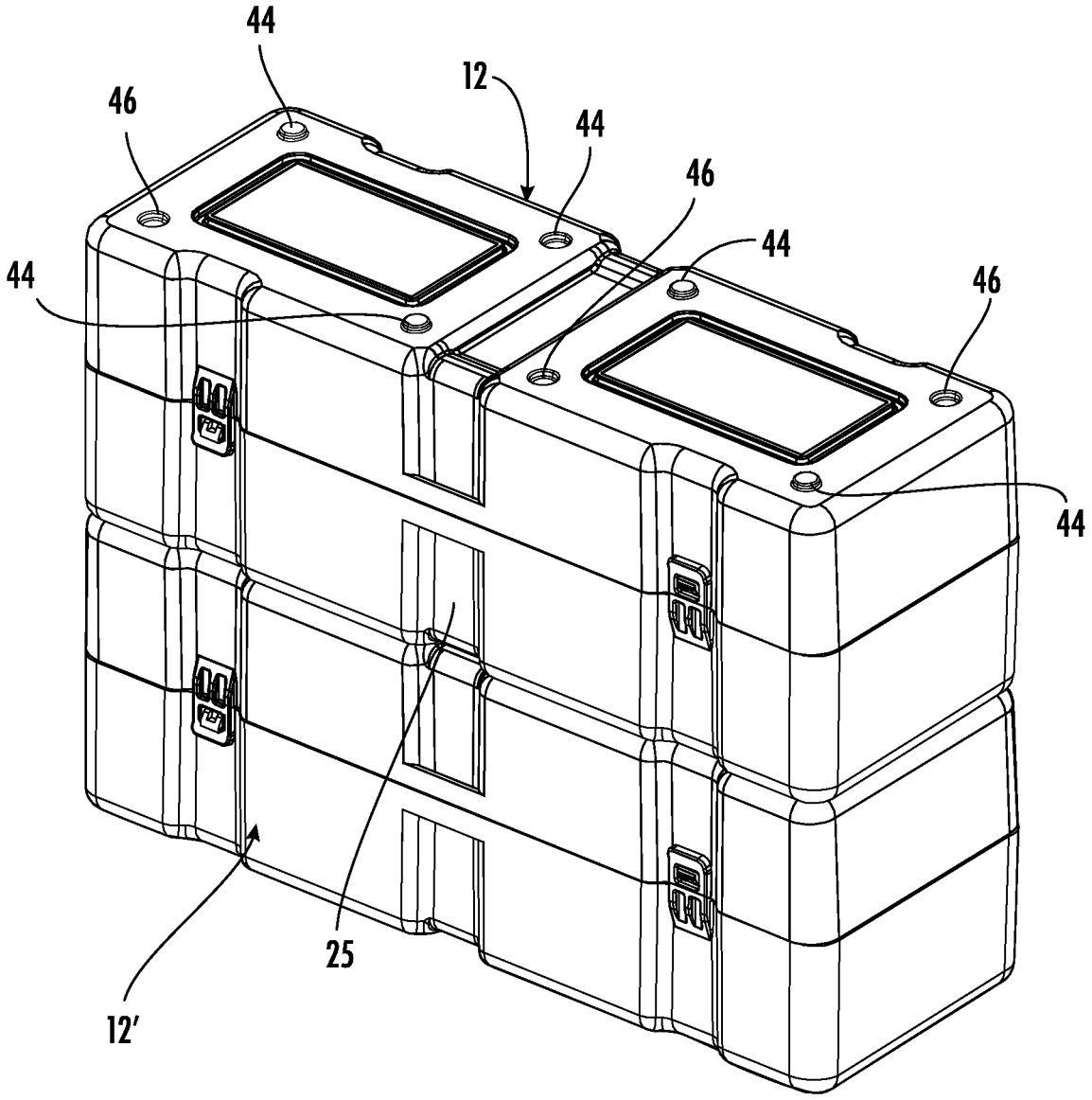
FIG. 14 is a perspective view illustrating a method of using the apparatus of FIG. 1 with a like apparatus.
Figure 15:
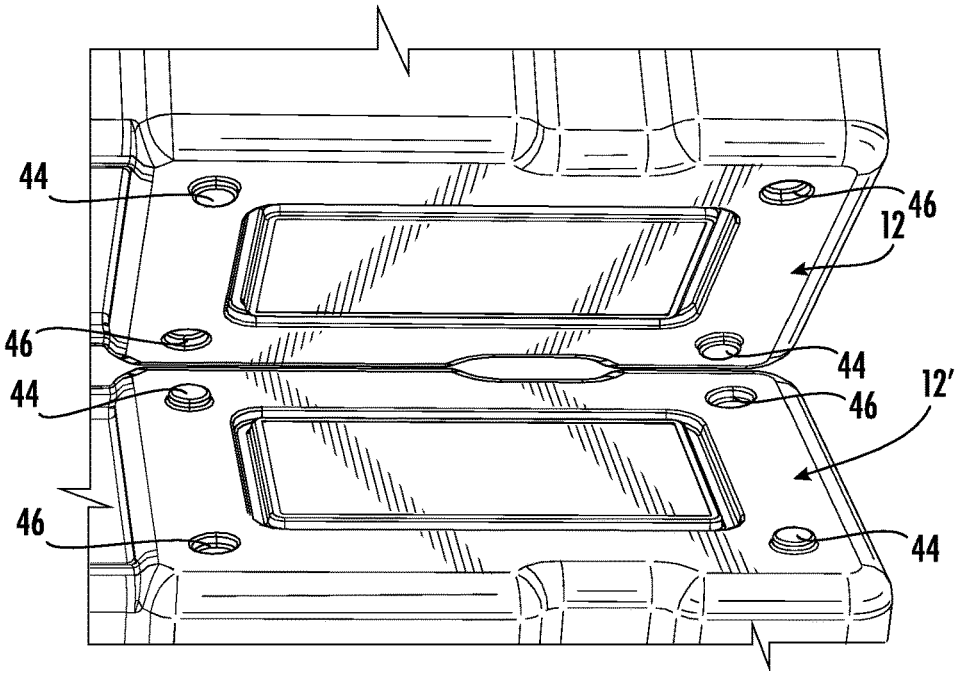
FIG. 15 is a partial perspective view of the apparatuses of FIG. 14.
Figure 16:
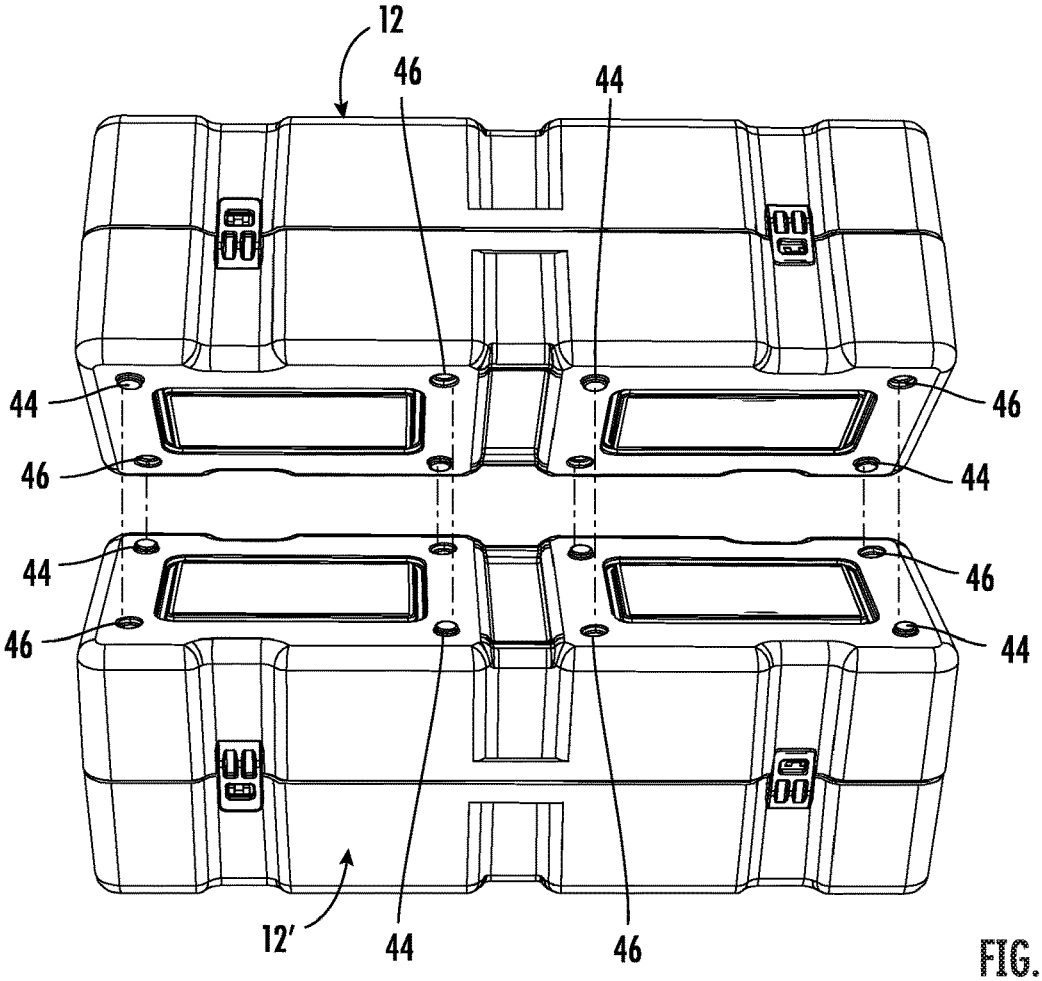
FIG. 16 is a perspective view of the apparatuses of FIG. 14.

According to a preferred embodiment of the invention, the container 12 can have a plurality of knobs 44 extending upwardly from the top surface of the container 12 and extending downwardly from the bottom surface of the container 12, and a plurality of complementary circular recesses 46 formed in the top and bottom surfaces of the container 12, as shown in FIGS. 14-16. The recesses 46 are shaped and sized to receive and engage the knobs 44 to facilitate stacking of the container 12 on another like container 12', as shown in FIG. 14. When one container 12 is positioned on top of another like container 12', the knobs 44 extending upwardly from the top surface of the bottom container 12' are received in the recesses 46 formed in the bottom surface of the top container 12, thereby stabilizing the container 12 on the container 12', and preventing the container 12 from slipping off of the container 12'. As such, multiple containers can be stacked on top of each other.

Figure 17:
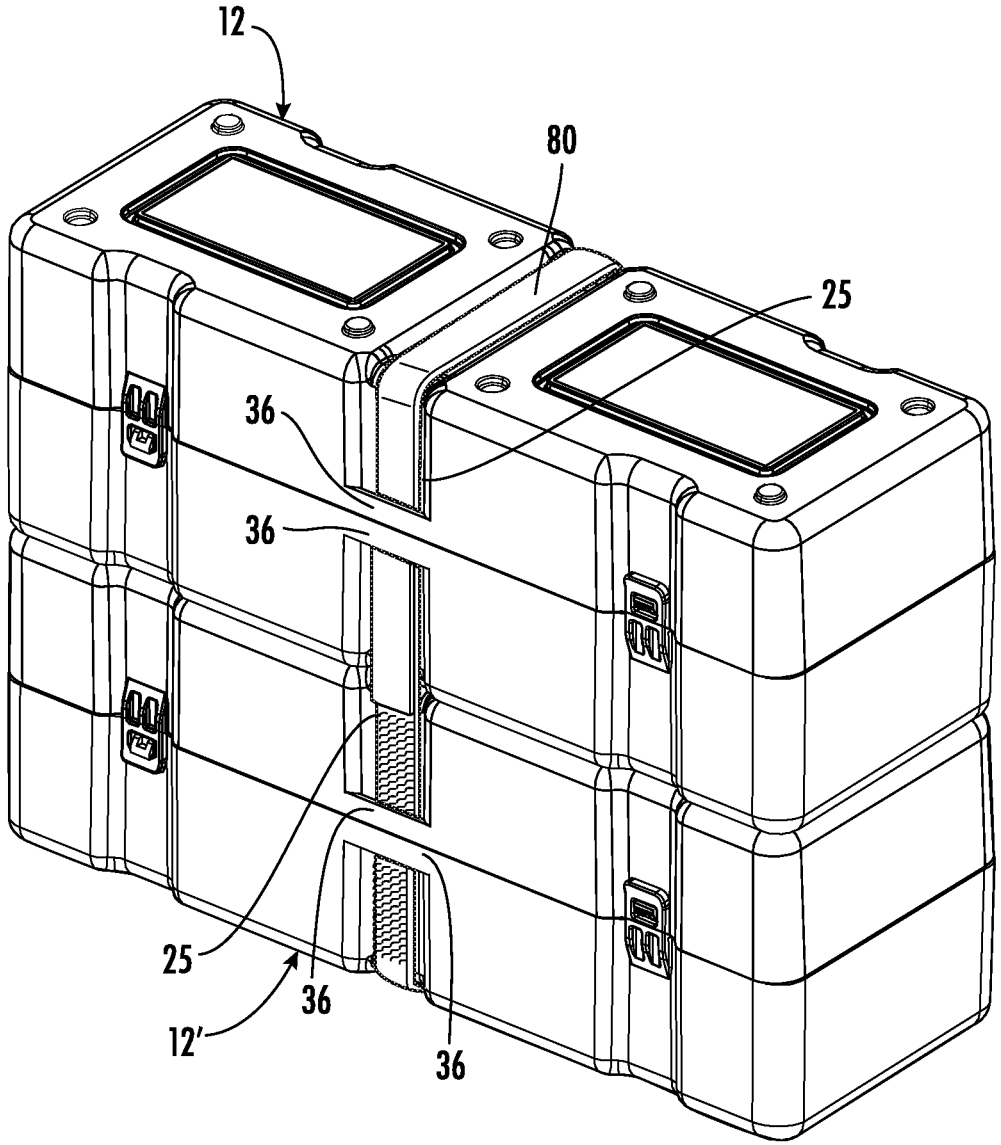
FIG. 17 is another perspective view of the apparatuses of FIG. 14.

As shown in FIGS. 5-8, the container 12 can have an indented channel 25 that is concave in relation to the exterior surface of the container 12. The indented channel 25 is formed approximately mid-way on the container 12, and extends around on all sides of the container 12. Each housing section 21, 22 has a pair of panels 36, 37 positioned on opposite sides of the container 12 and extending over the indented channel 25 thereby forming an aperture through which a fastening member 80 can be positioned to secure multiple stacked containers 12, 12' together, as shown in FIG. 17. The fastening member 80 can be a strap with first and second opposed sides. A plurality of hook fasteners can be positioned on one side, and a plurality of complementary loop fasteners can be positioned on the opposite side of the strap. The strap 80 can be wrapped around the containers 12, 12', and the hook and loop fasteners engage each such that the strap 80 is tight around the containers 12, 12'. Alternatively, the fastening member 80 can be a plastic zip tie or cable tie.

Figure 28:
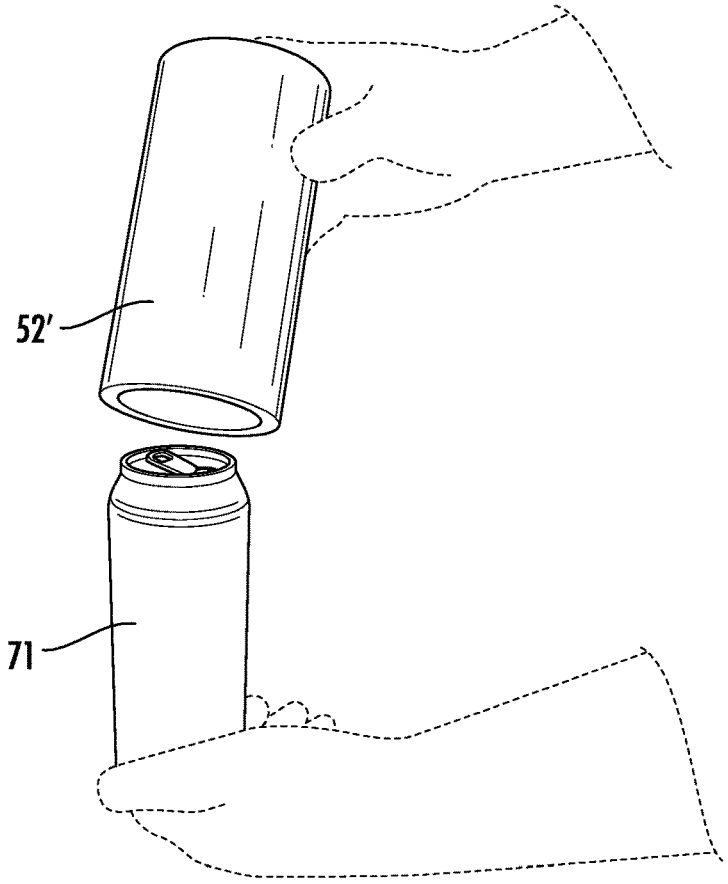
FIG. 28 is an environmental perspective view of a component of FIG. 26.
Figure 29:
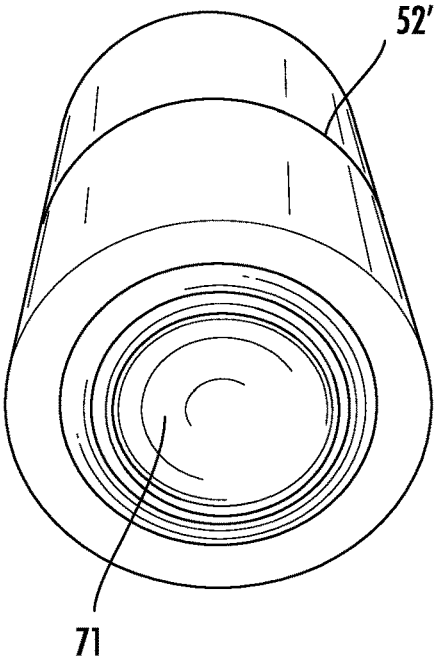
FIG. 29 is another environmental perspective view of a component of FIG. 26.
Figure 30:
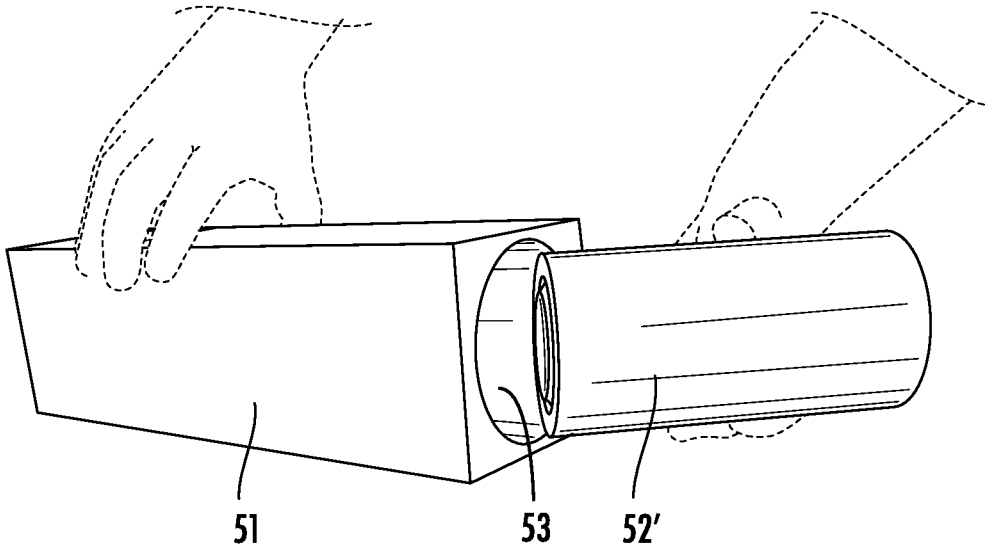
FIG. 30 is another environmental perspective view of a component of FIG. 26.
Figure 31:
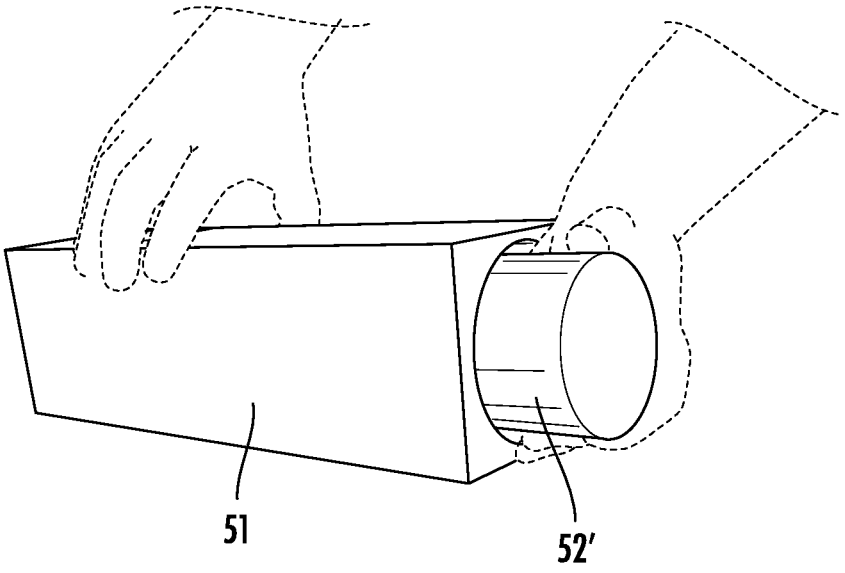
FIG. 31 is another environmental perspective view of a component of FIG. 26.
Figure 32:
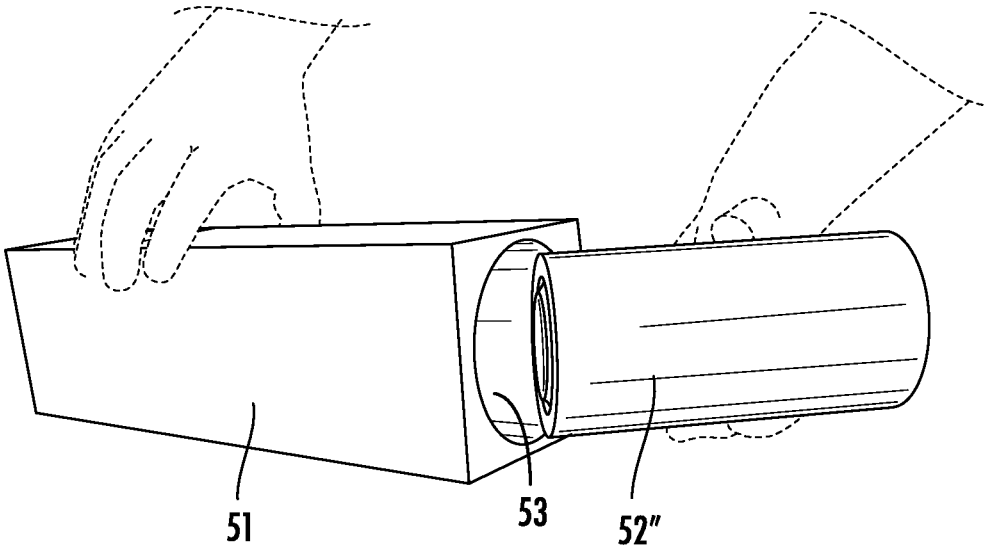
FIG. 32 is another environmental perspective view of a component of FIG. 26.
Figure 33:
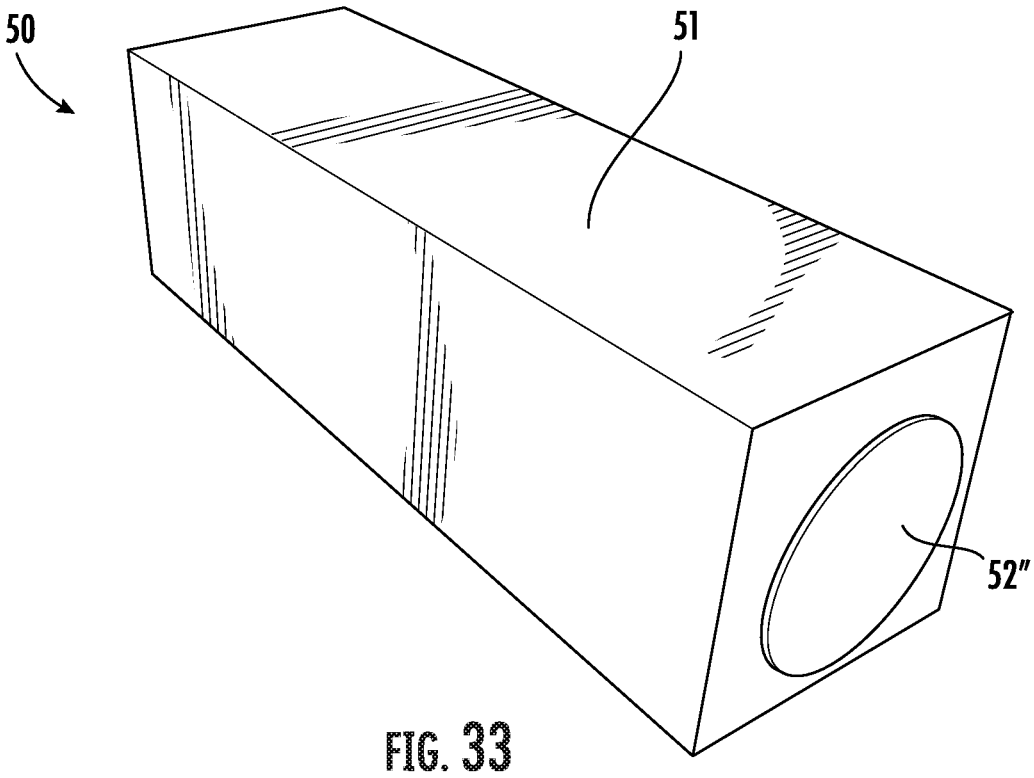
FIG. 33 is another environmental perspective view of a component of FIG. 26.

According to another embodiment of the invention, the container apparatus 10 can be used to transport two cans 71, 72, as shown in FIGS. 26-33. Preferably, the cans are the 16 oz. beverage cans typically sold in the United States for beer, soft drinks and the like. In this embodiment, the cushioning member 50 comprises the rectangular member 51 and a pair of hollow cylindrical cushioning members 52', 52". One can 71 is positioned top end first into a cylindrical member 52', as shown in FIG. 28, and the cylindrical member 52' is inserted open end first into the cylindrical opening 53 of the rectangular member 51 until the cylindrical member 52' and can 71 reach the base of the cylindrical opening 53, as shown in FIGS. 31 and 33. The other can 72 is likewise positioned into the other cylindrical member 52", and the cylindrical member 52" is inserted open end first into the cylindrical opening 53, as shown in FIG. 32, until it contacts the other cylindrical member 52'. At this point, cylindrical member 52" can be substantially flush with the rectangular member 51, as shown in FIG. 33. The rectangular member 51 is positioned into one of the housing sections 21, 22, and the housing sections 21, 22 are attached together again, as described above. The cans 71, 72 securely contained within the container 12, can be securely shipped to a distant location, such as by U.S. mail or private delivery service.

A container apparatus and method of using same are described above. Various changes can be made to the invention without departing from its scope. The above description of various embodiments of the invention are provided for the purpose of illustration only and not limitation—the invention being defined by the claims and equivalents thereof.

What is claimed is:

1. A container apparatus comprising:

(a) a housing comprising a first housing section releasably attached to a second housing section via a plurality of tab members and a plurality of locking members adapted for complementary releasable engagement with the plurality of tab members, the housing defining an interior area therein;

(b) a cushioning member positioned within the interior area of the housing, the cushioning member adapted to contain an item and provide a barrier between the item and the housing that absorbs force from an impact to the housing; and (c) wherein the housing has a substantially rectangular prism shape, and the first housing section and the second housing section each comprise a rectangular face panel and a rectangular sidewall extending outwardly from the face panel, the sidewall comprising first and second opposed sides and third and fourth opposed sides, the first housing section comprising a first tab member positioned on the first side of the first housing section and extending outwardly therefrom and a second tab member positioned on the second side of the first housing section and extending outwardly therefrom, and the second housing section comprising a first locking member positioned on the first side of the second housing section to receive and releasably engage the first tab member of the first housing section, and a second locking member positioned on the second side of the second housing section to receive and releasably engage the second tab member of the first housing section, and further wherein the second housing section further comprises a first tab member positioned on the first side of the second housing and a second tab member positioned on the second side of the second housing section, and the first housing section further comprises a first locking member positioned on the first side of the first housing section to receive and releasably engage the first tab member of the second housing section, and a second locking member positioned on the second side of the first housing section to receive and releasably engage the first tab member of the second housing section, whereby the first housing section is releasably attached to the second housing section.

2. The container apparatus according to claim 1, wherein the housing is comprised of propylene plastic.

3. The container apparatus according to claim 1, wherein the cushioning member is comprised of polyethylene foam.

4. The container apparatus according to claim 1, wherein the item comprises at least one selected from the group consisting of a bottle and a can.

5. The container apparatus according to claim 1, wherein the cushioning member comprises a body section having a substantially rectangular prism shape and a substantially cylindrical cavity formed therein, and the item comprises a bottle and the substantially cylindrical cavity of the body section of the cushioning member receives the bottle therein, and the cushioning member further comprises a top section removably positioned within the substantially cylindrical cavity of the body section, the top section having a substantially cylindrical shape and defining a substantially cylindrical cavity for receiving at least a portion of a neck of the bottle therein.

6. The container apparatus according to claim 1, wherein the cushioning member comprises a body section having a substantially rectangular prism shape and a substantially cylindrical cavity formed therein, and wherein the item comprises first and second cans, and the cushioning member further comprises a first cylindrical member defining a cylindrical cavity for receiving the first can therein and a second cylindrical member defining a cylindrical cavity for receiving the second can therein, the first and second cylindrical members positioned within the substantially cylindrical cavity of the body section.

7. The container apparatus according to claim 1, wherein the face panel of each of the first housing section and the second housing section include a plurality of knobs extending outwardly therefrom and a plurality of recesses formed therein to facilitate stacking of the container apparatus with a like container apparatus.

8. The container apparatus according to claim 1, wherein the first side and the second side of each of the first housing section and the second housing section include indented sections, and each of the first and second tab members and each of the first and second locking members are positioned in one of the indented sections.

9. A container apparatus kit comprising first and second container apparatuses, wherein each apparatus comprises:

(a) a housing comprising a first housing section releasably attached to a second housing section via a plurality of tab members and a plurality of locking members adapted for complementary releasable engagement with the plurality of tab members, the housing defining an interior area therein;

(b) a cushioning member positioned within the interior area of the housing, the cushioning member adapted to contain an item and provide a barrier between the item and the housing that absorbs force from an impact to the housing; and (c) wherein the housing has a substantially rectangular prism shape, and the first housing section and the second housing section each comprise a substantially rectangular face panel and a substantially rectangular sidewall extending outwardly from the face panel, the sidewall comprising first and second opposed sides and third and fourth opposed sides, the face panel of the first housing section defining a top of the housing and the face panel of the second housing section defining a bottom of the housing, wherein the face panel of the first housing section and the face panel of the second housing section each have a plurality of knobs extending outwardly therefrom and a plurality of circular recesses formed therein such that when the first container apparatus is positioned on the top of the second container apparatus the plurality of knobs extending outwardly from top of the second container apparatus are received in the plurality of circular recesses formed in the bottom of the first container apparatus and the plurality of knobs extending outwardly from the bottom of the first container apparatus are received in the plurality of circular recesses formed in the top of the second container apparatus, whereby the first container apparatus is frictionally engaged with the second container apparatus, and wherein the first housing section comprises a first tab member positioned on the first side of the first housing section and extending outwardly therefrom and a second tab member positioned on the second side of the first housing section and extending outwardly therefrom, and the second housing section comprising a first locking member positioned on the first side of the second housing section to receive and releasably engage the first tab member of the first housing section, and a second locking member positioned on the second side of the second housing section to receive and releasably engage the second tab member of the first housing section, and further wherein the second housing section further comprises a first tab member positioned on the first side of the second housing and a second tab member positioned on the second side of the second housing section, and the first housing section further comprises a first locking member positioned on the first side of the first housing section to receive and releasably engage the first tab member of the second housing section, and a second locking member positioned on the second side of the first housing section to receive and releasably engage the first tab member of the second housing section, whereby the first housing section is releasably attached to the second housing section.

10. The container apparatus kit according to claim 9, further comprising an indented section formed in the first and second housing sections of each of the first and second container apparatuses, and a fastening member for positioning within the indented section of the first container apparatus and the indented section of the second container apparatus when the first container apparatus is positioned on top of the second container apparatus.

11. The container apparatus kit according to claim 10, wherein the fastening member comprises a strap having a first and a second surface opposed to the first surface, wherein a plurality of hook fasteners are positioned on the first surface and a plurality of loop fasteners adapted for complementary engagement with the plurality of hook fasteners are positioned on the second surface.

12. The container apparatus kit according to claim 9, wherein the housing of each of the first and second container apparatuses is comprised of propylene plastic, and the cushioning member of each of the first and second container apparatuses is comprised of polyethylene foam.

13. The container apparatus kit according to claim 9, wherein the item comprises at least one selected from the group consisting of a bottle and a can, the housing of each of the first and second container apparatuses has a substantially rectangular prism shape, the cushioning member of each of the first and second container apparatuses comprises a body section having a substantially rectangular prism shape and a substantially cylindrical cavity formed therein and a top section removably positioned within the substantially cylindrical cavity of the body section, the top section having a substantially cylindrical shape and defining a substantially cylindrical cavity for receiving at least a portion of a bottle neck therein.

14. The container apparatus kit according to claim 13, further comprising a first cylindrical member defining a cylindrical cavity for receiving the first can therein and a second cylindrical member defining a cylindrical cavity for receiving the second can therein, the first and second cylindrical members comprising a shock absorbing material and sized such that the first and second cylindrical members can be positioned within the substantially cylindrical cavity of the body section of the cushioning member of each of the first and second container apparatuses.

15. A container apparatus kit comprising:

(a) a housing comprising a first housing section releasably attached to a second housing section via a plurality of tab members and a plurality of locking members adapted for complementary releasable engagement with the plurality of tab members, the housing having a substantially rectangular prism shape and defining an interior area therein;

(b) a first cushioning member positioned within the interior area of the housing, the first cushioning member comprising a body section having a substantially rectangular prism shape and a substantially cylindrical cavity formed therein;

(c) second and third cushioning members adapted to be positioned within the substantially cylindrical cavity formed in the first cushioning member, the second and third cushioning members each comprising a body having a substantially cylindrical body section and a substantially cylindrical cavity formed therein for receiving and containing a can therein, whereby a first can be positioned within the substantially cylindrical cavity formed in the second cushioning member, a second can be positioned within the substantially cylindrical cavity formed in the third cushioning member, and the second and third cushioning members can be positioned within the substantially cylindrical cavity formed in the first cushioning member; and (d) wherein the housing has a substantially rectangular prism shape, and the first housing section and the second housing section each comprise a rectangular face panel and a rectangular sidewall extending outwardly from the face panel, the sidewall comprising first and second opposed sides and third and fourth opposed sides, the first housing section comprising a first tab member positioned on the first side of the first housing section and extending outwardly therefrom and a second tab member positioned on the second side of the first housing section and extending outwardly therefrom, and the second housing section comprising a first locking member positioned on the first side of the second housing section to receive and releasably engage the first tab member of the first housing section, and a second locking member positioned on the second side of the second housing section to receive and releasably engage the second tab member of the first housing section, and further wherein the second housing section further comprises a first tab member positioned on the first side of the second housing and a second tab member positioned on the second side of the second housing section, and the first housing section further comprises a first locking member positioned on the first side of the first housing section to receive and releasably engage the first tab member of the second housing section, and a second locking member positioned on the second side of the first housing section to receive and releasably engage the first tab member of the second housing section, whereby the first housing section is releasably attached to the second housing section.

16. The container apparatus kit according to claim 15, further comprising a fourth cushioning member adapted to be positioned within the substantially cylindrical cavity formed in the first cushioning member, and comprising a substantially cylindrical body section and a substantially cylindrical cavity formed therein for receiving a bottle therein and a top section adapted to be removably positioned within the substantially cylindrical cavity of the body section, the top section having a substantially cylindrical shape and defining a substantially cylindrical cavity for receiving at least a portion of a neck of the bottle therein.

* * * * *